US008162680B2

(12) United States Patent
Zhu

(10) Patent No.: US 8,162,680 B2
(45) Date of Patent: Apr. 24, 2012

(54) BOARD-MOUNTED ELECTRICAL CONNECTOR

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/874,376

(22) Filed: Sep. 2, 2010

(65) Prior Publication Data

US 2011/0104909 A1 May 5, 2011

(30) Foreign Application Priority Data

Oct. 29, 2009 (CN) ..... 200910309007
Apr. 27, 2010 (CN) ..... 201020171949

(51) Int. Cl.
*H01R 12/00* (2006.01)

(52) U.S. Cl. ..... 439/79

(58) Field of Classification Search ..... 439/79, 439/80

See application file for complete search history.

(56) References Cited

U.S. PATENT DOCUMENTS

| | | | | |
|---|---|---|---|---|
| 6,699,049 | B1 * | 3/2004 | Wu | 439/79 |
| 6,767,235 | B2 | 7/2004 | Wu | |
| 6,923,664 | B2 * | 8/2005 | Ito et al. | 439/108 |
| 6,981,898 | B2 * | 1/2006 | Akama et al. | 439/607.09 |
| 2007/0015385 | A1 * | 1/2007 | Yang | 439/79 |

* cited by examiner

*Primary Examiner* — Phuong Dinh

(74) *Attorney, Agent, or Firm* — Wei Te Chung; Andrew C. Cheng; Ming Chieh Chang

(57) ABSTRACT

An electrical connector includes an insulative housing and a plurality of terminals secured in the insulative housing. The insulative housing defines a front face and a rear face opposite to the front face. The housing further includes at least one tongue portion extending forwardly from the front face. At least one receiving space is recessed in the rear face and corresponding to the at least one tongue portion. Each terminal includes a retention portion secured in the insulative housing, a contact portion extending forwardly from one end of the retention portion and a tail portion extending from the other end of the retention portion. The contact portion is located on the at least tongue portion. The tail portions bend toward the front face and are received in the receiving space.

10 Claims, 7 Drawing Sheets

BOARD-MOUNTED ELECTRICAL CONNECTOR

BACKGROUND OF THE INVENTION

1. Field of the Invention

The present invention relates generally to an electrical connector, and more particularly to an adaptor type electrical connector.

2. Description of Related Art

U.S. Pat. No. 6,767,235 issued to Jerry Wu on Jul. 27, 2004 discloses a conventional electrical connector which is mounted on a printed circuit board. The electrical connector comprises an insulative housing and a plurality of terminals secured in the housing. The insulative housing defines a base and a pair of tongue portions extending forwardly from the base. Each terminal comprises a retention portion retained in the base, a contact portion extending forwardly from the retention portion and a tail portion extending rearward from the retention portion. However, the contact portions and tail portions extend in opposite directions so that the electrical connector has a large size.

Hence, it is desired to provide an electrical connector to overcome the problems mentioned above.

BRIEF SUMMARY OF THE INVENTION

An electrical connector comprises an insulative housing and a plurality of terminals secured in the insulative housing. The insulative housing defines a front face and a rear face opposite to the front face. The housing further comprises at least one tongue portion extending forwardly from the front face. At least one receiving space is recessed in the rear face and corresponding to the at least one tongue portion. Each terminal comprises a retention portion secured in the insulative housing, a contact portion extending forwardly from one end of the retention portion and a tail portion extending from the other end of the retention portion. The contact portion is located on the at least tongue portion. The tail portions bend toward the front face and are received in the receiving space.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
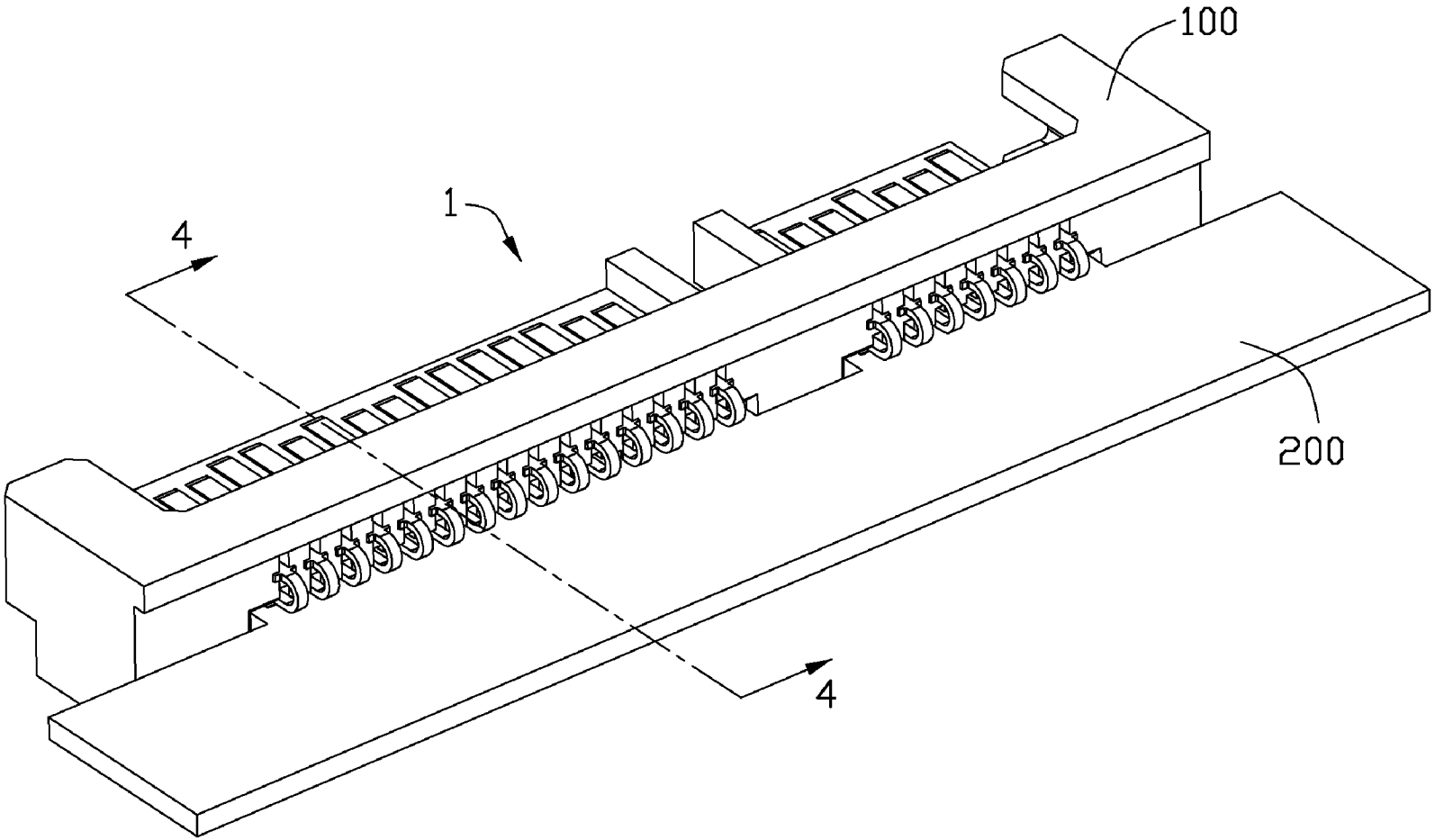
FIG. 1 is a perspective view of an electrical connector assembly according to the present invention.
Figure 2:
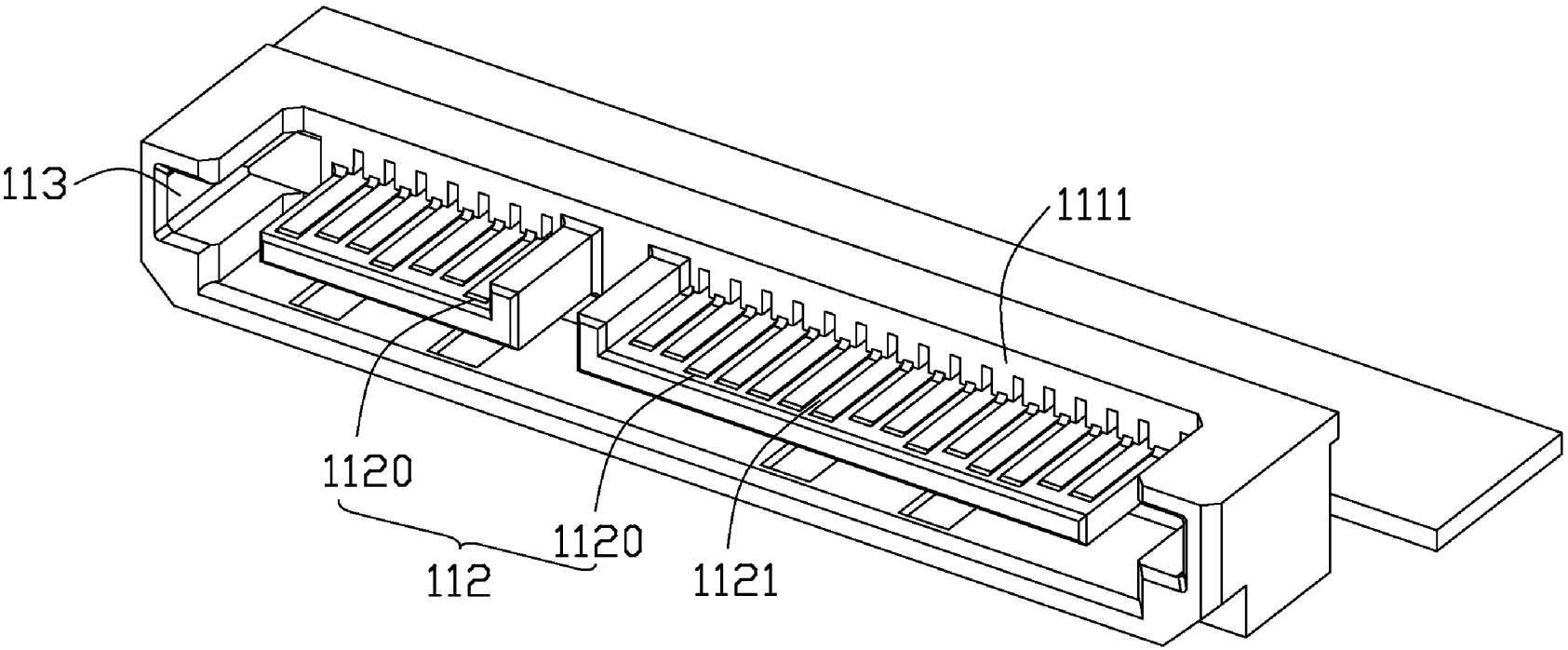
FIG. 2 is another view of the electrical connector assembly shown in FIG. 1.

Reference will be made to the drawing figures to describe the present invention in detail, wherein depicted elements are not necessarily shown to scale and wherein like of similar elements are designated by same or similar reference numeral through the several views and same or similar terminology.

Referring to FIGS. 1-4, an electrical connector assembly 1 according to a first embodiment of the present invention comprises an electrical connector 100 and a first electronic element, such as a PCB 200 electrically connected with the connector. The electrical connector 100 comprises an insulative housing 110 and a plurality of terminals 120 assembled to the insulative housing 110.

The insulative housing 110 comprises a longitudinal base portion 111 defining a front face 1111 and a rear face 1112 opposite to the front face 1111, two guide portions 113 and a mating portion 112 unitarily extending forwardly from the front face 1111 of the base portion 111. The two guide portions 113 are adapted to guide a second electrical element, such as a mating connector (not shown) to mate with the electrical connector 100. The mating portion 112 comprises a pair of L-shaped tongue portions 1120 with different dimensions. The L-shaped tongue portions 1120 are located between the two guide portions113. Two receiving spaces 1113 arranged side by side are recessed in the rear face 1112 of the base portion 111 corresponding to the two tongue portions 1120 and spaced by a partition wall 1119. A plurality of passageways 130 penetrate through the front and rear face 1111, 1112 of the base portion 111 and are located above the receiving spaces 1113.

Each terminal 120 comprises a retention portion 121 with barbs secured in the passageways 130 of the base portion 111 of the insulative housing 110, a plate contact portion 122 extending forwardly from a front end of the retention portion 121 and a tail portion 123 extending from a rear end of the retention portion 121. The contact portions 122 of terminals 120 are located in the upper surface 1121 of the tongue portions 1120. The tail portions 123 bend toward the front face 1111 and comprise U-shaped or C-shaped bent sections 1231 extending beyond the rear face 1112 and soldering sections 1232 received in the receiving space 1113 and extending toward the front face 1111.

The receiving space 1113 of the base portion 111 defines a top face 1116 perpendicular to the rear face 1112 and a plurality of recesses 1115 are formed in the top face 1116 and accommodate with the receiving space adapted to position the soldering sections 1232 of terminals 120. A plurality of terminal passageways 1117 are formed above and aligned with the recesses to retain the retention portions 121. The soldering section 1232 has a distal end 1234 extending obliquely toward the retention portions 121. Several ribs 1118 are formed on a bottom face opposite to the top face in a front-to-back direction.

Figure 3:
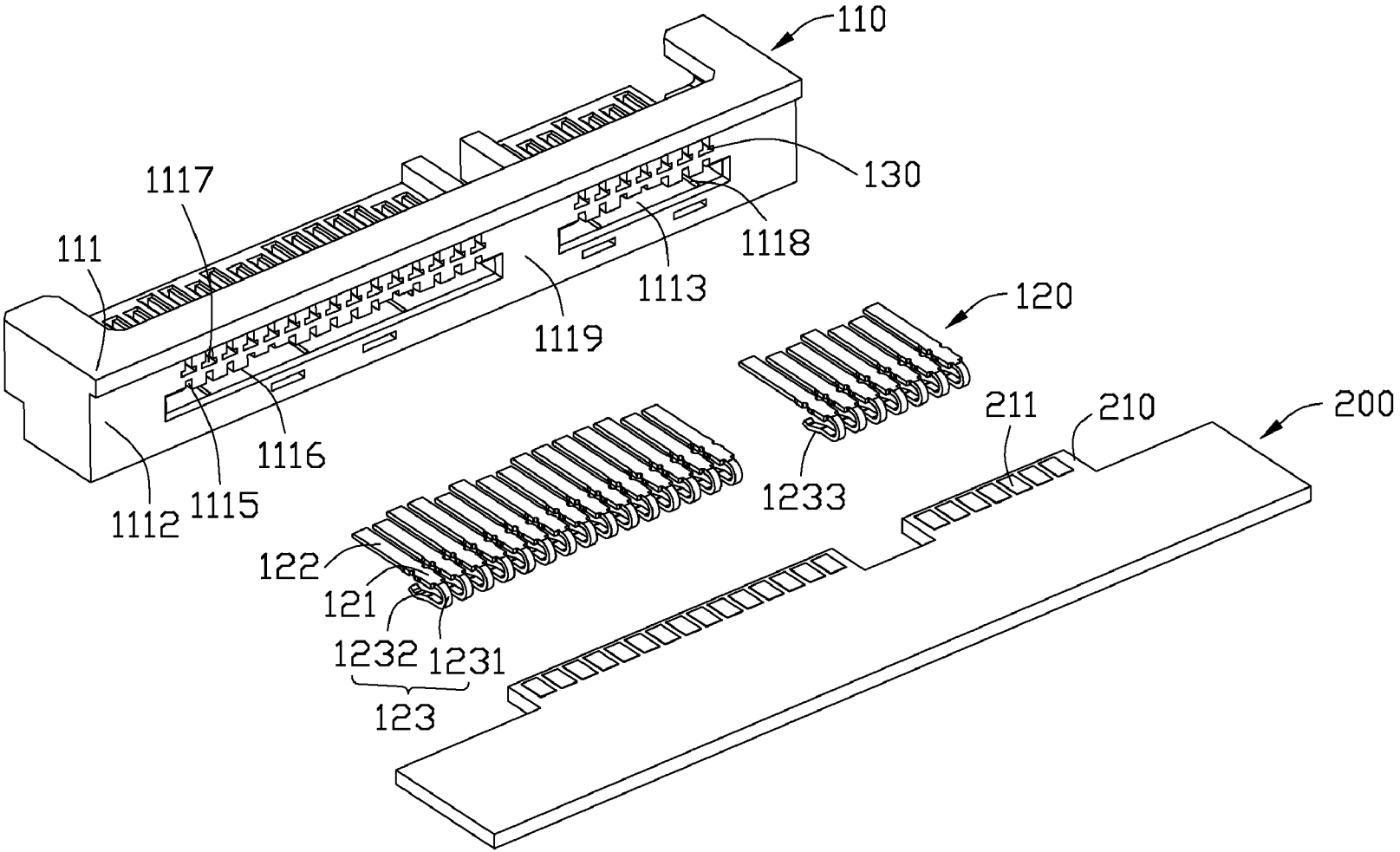
FIG. 3 is an exploded view of the electrical connector assembly shown in FIG. 1.
Figure 4:
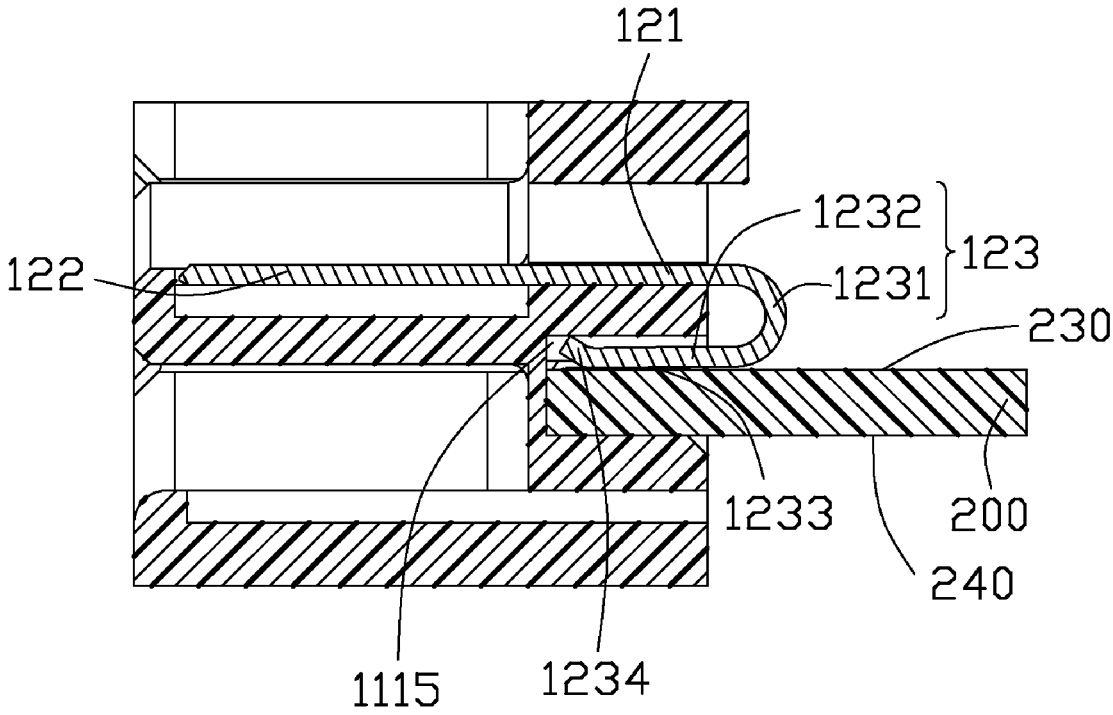
FIG. 4 is a cross sectional view of the electrical connector assembly taken along line 4-4 in FIG. 1.

Referring to FIGS. 3-4, the PCB 200 defines a first surface 230 and a second surface 240 opposite to the first surface 230. The PCB 200 comprises a pair of mating portions 210 with conductive pads 211 located on the first surface 230, the mating portions are inserted in the receiving spaces 113. The soldering section 1232 of each terminal 120 defines a contact face 1233 extending beyond the top face 1116 so as to electrically contact the corresponding conductive pad 211 of the PCB 200. The ribs 1118 formed on the bottom face engage with the second surface 240 of the PCB 200 so as to keep a stable engagement of the contact face and the second surface and decrease an inserted force of the PCB 200 into the receiving space 113.

In assembly, the terminals 120 are assembled to the insulative housing 110 from the rear face 1112 of the base portion 111. Then the mating portions 210 of PCB 200 are inserted into the receiving space 1113 of the base portion 111 so that the soldering portions 123 of terminals 120 elastically deform back to the recessed 1115 and the contact face 1233 press against the conductive pads 211 of the PCB 200 to complete an electrical and mechanical engagement of the connector and the PCB. And last the soldering portions 123 are welded to the PCB by melt process. Alternatively, the element 1232 named as the soldering portions are elastically engaged with the PCB by the elasticity thereof without soldering process, thus the element 1232 also can named as elastic portions. The free ends 1234 abut against the insides of the recesses to increase elasticity of the elastic portions. Please notes, the contact surface of contact plate 122 face upwards and the contact surface 1233 face downward opposite to the contact plate 122.

Figure 5:
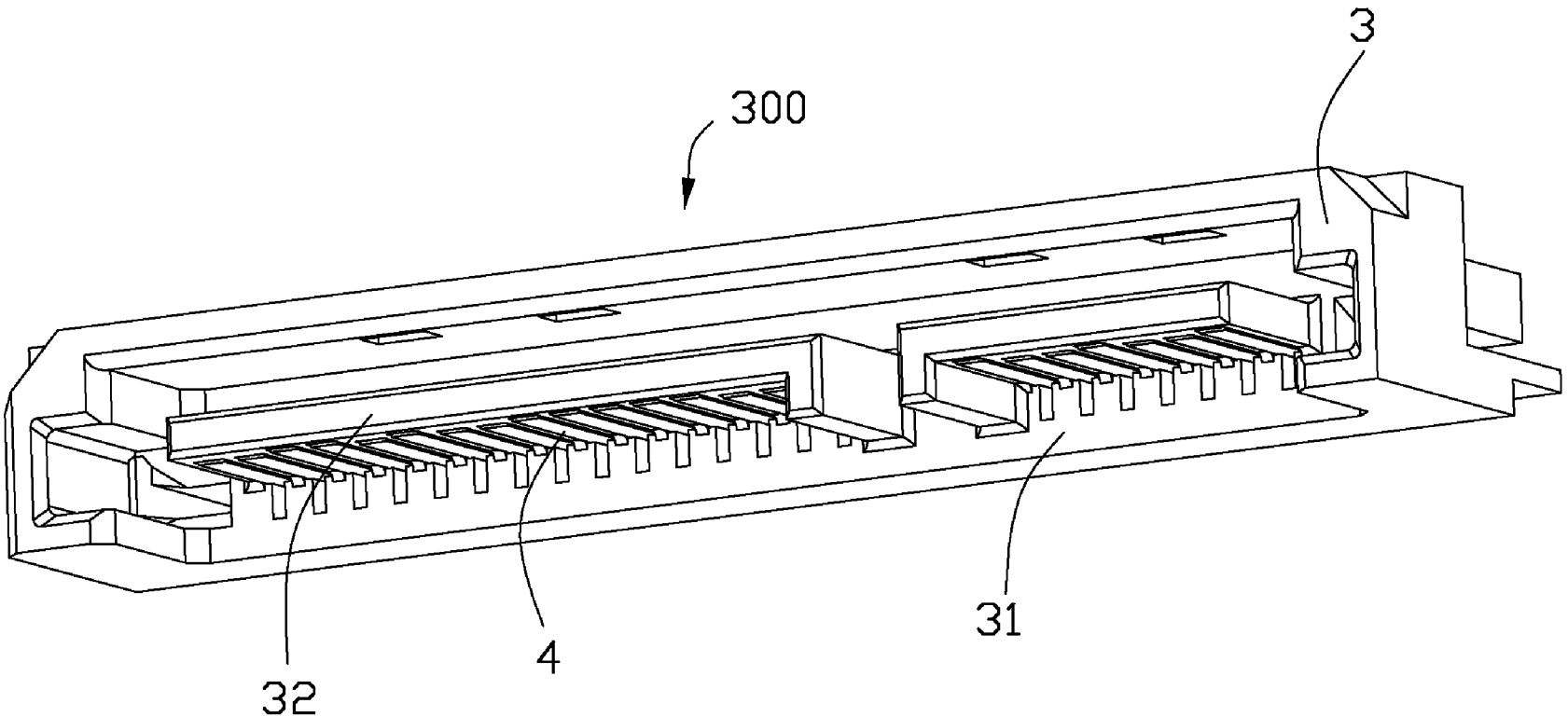
FIG. 5 is a perspective view of the electrical connector of a second embodiment of this present invention.
Figure 6:
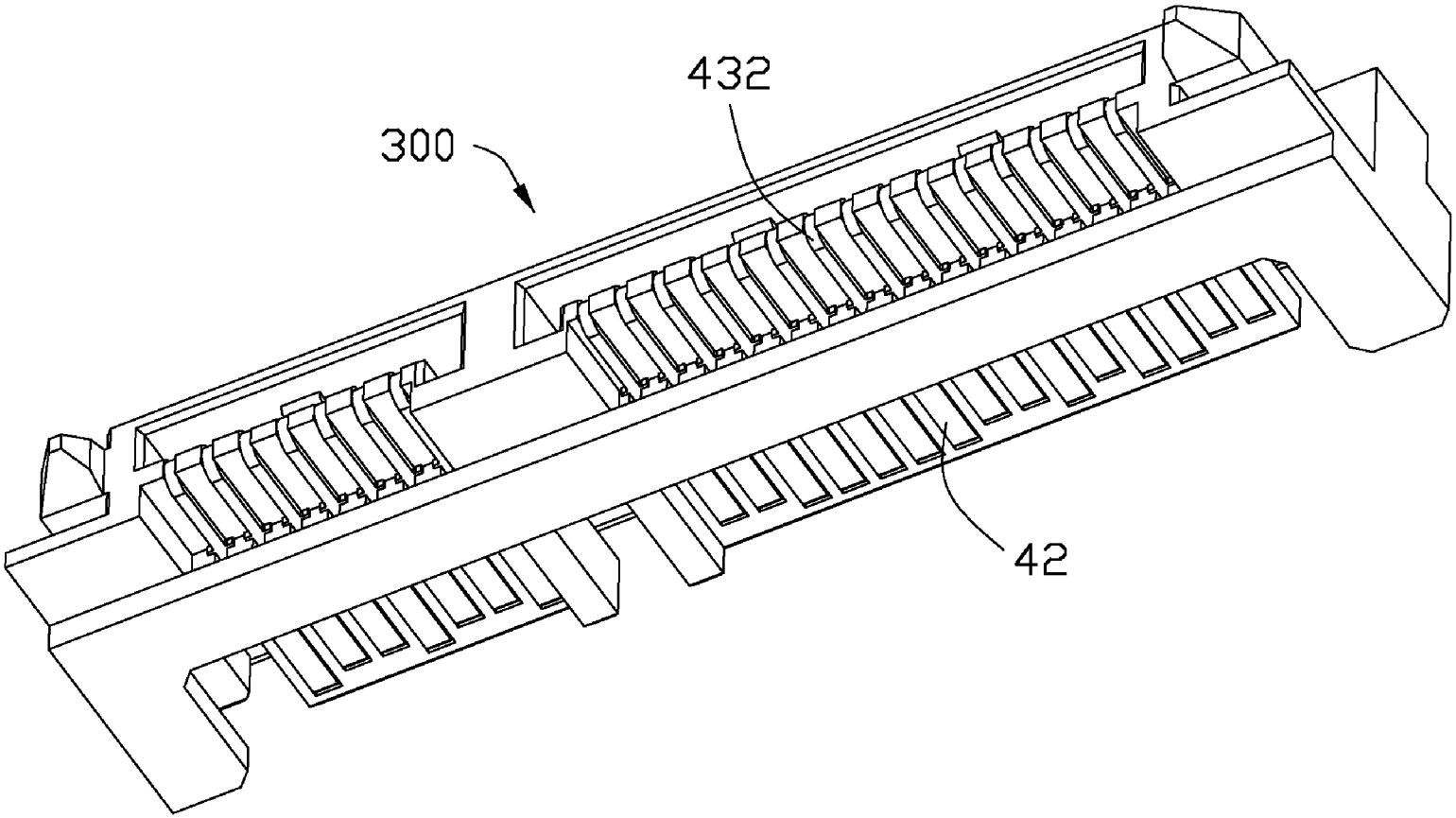
FIG. 6 is another perspective view of the electrical connector shown in the FIG. 5.
Figure 7:
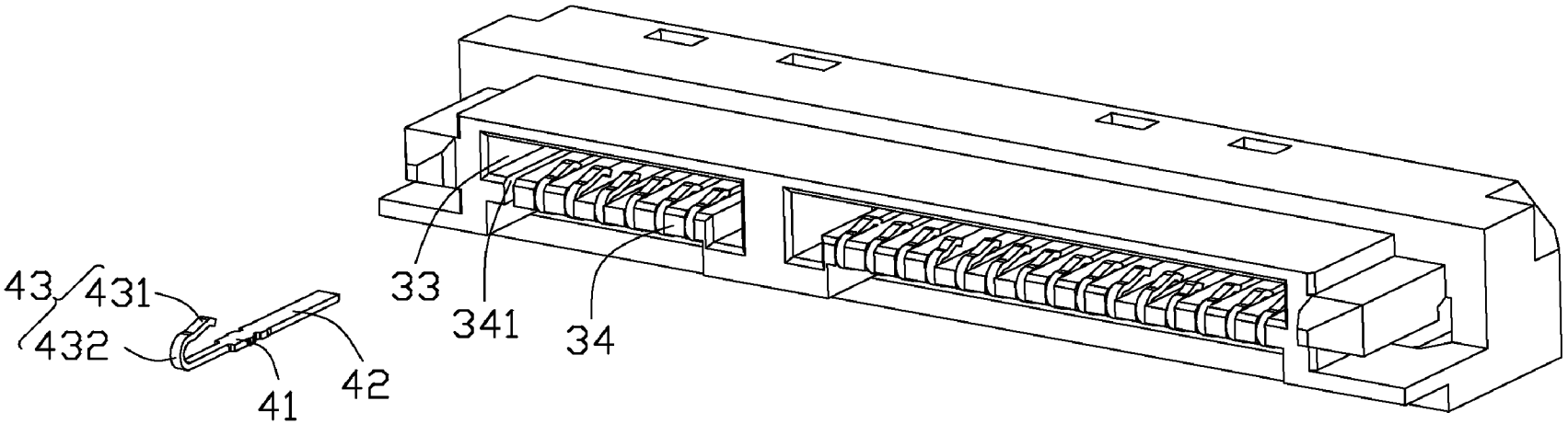
FIG. 7 is a partially exploded view of the electrical connector shown in the FIG. 5.

In a second embodiment shown in FIGS. 5-7, an electrical connector 300 similar to the electrical connector 100 of the first embodiment, while the electrical connector are mated with two mating connectors functioning as an adaptor, i.e., the first electronic element is of a mating connector type, not of a PCB type. The electrical connector comprises an insulative housing 3 and a plurality of terminals 4 assembled to the insulative housing 3. The insulative housing 3 comprises a base portion 31 and a mating portion 32 extending from the base portion 31. The mating portion 32 comprises a pair of inverted L-shaped tongue portions. The base portion 31 defines a pair of inverted L-shaped receiving spaces 33 opposite to the mating portion 31. The receiving spaces 33 are used to receive the mating connector. A plurality of recesses 341 are formed in bottom walls 34 of the receiving spaces 33 and run through the bottom walls 34. The mating portion 32 defines a plurality of passageways penetrating through the base portion 31.

Each terminal comprises a retention portion 41, a plate contact portion 42 extending from an end of the retention portion 41 and a tail portion 43 extending from the other end of the retention portion 41. The plate contact portion 42 is received in the passageways of the mating portion 32. The tail portion 43 comprises a bent portion 432 and an elastic portion 431 extending obliquely toward the receiving space 33. The bent portions 432 hide in the recessed 341 and not beyond the rear face of the receiving spaces. When a mating portion of the mating connector (not shown) is inserted into the receiving space 33, the elastic portions 431 are urged into the corresponding recesses 341.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly, comprising:

a first electronic element of a mating electrical connector;

a second electronic element defining a mating portion;

an insulative housing defining a mating portion at a front face thereof to mate with the mating connector and a receiving space recessed at a rear face to receive the mating portion of the second electronic element; and a plurality of terminals, each terminal comprising a contact portion located in the mating portion to electrically and mechanically engage with the first electrical element and a tail portion bending in the receiving space to elastically press against the second electronic element;

wherein the tail portion comprises a bent portion and an elastic portion extending forward in the receiving space.

2. The electrical connector assembly as claimed in claim 1, wherein a plurality of recesses is formed communicating with the receiving space so that the elastic portions can move into the recesses.

3. The electrical connector assembly as claimed in claim 2, wherein contacting surfaces of the elastic portions mating with the second electronic element and contacting surfaces of the contact portions mating with the first electronic element face in two opposite directions.

4. The electrical connector assembly as claimed in claim 3, wherein the elastic portion has a distal free end extending slantly toward recess which will abut against insides of recesses.

5. An electrical connector assembly comprising:

an insulative housing defining a front mating port and a rear PCB (Printed Circuit Board) mounting port, said front mating port defining a receiving cavity with a mating tongue extending therein, said rear PCB mounting port defining a mating slot dimensioned with a height in compliance with a thickness of a printed circuit board;

a plurality of contacts disposed in the housing, each of said contacts defining a front horizontal mating section exposed upon the mating tongue in a first vertical direction, and a rear horizontal mounting section located at a different level with regard to the front horizontal mating section and exposed in the mating slot in a second vertical direction opposite to the first vertical direction for abutment against said printed circuit board received in said mating slot.

6. The electrical connector assembly as claimed in claim 5, wherein said rear horizontal mounting section resiliently abuts against the printed circuit board in said mating slot.

7. The electrical connector assembly as claimed in claim 6, wherein a free end of said rear horizontal mounting section abuts against the housing when the rear horizontal mounting section abuts against the printed circuit board in said mating slot.

8. The electrical connector assembly as claimed in claim 5, wherein a U-shaped connection portion is linked between the front horizontal mating section and the rear horizontal mounting section around a rear face of the housing.

9. The electrical connector assembly as claimed in claim 8, wherein said U-shaped structure is exposed outside of the rear face of the housing.

10. The electrical connector assembly as claimed in claim 5, wherein, said receiving cavity is larger than the mating slot in said first vertical direction in an overlapped manner.

* * * * *